United States Patent [19]

Jacobsson

[11] Patent Number: 4,768,729

[45] Date of Patent: Sep. 6, 1988

[54] YARN FEEDING DEVICE

[75] Inventor: Kurt A. G. Jacobsson, Ulricehamn, Sweden

[73] Assignee: Aktielbolaget IRO, Ulricehamn, Sweden

[21] Appl. No.: 90,255

[22] PCT Filed: Nov. 18, 1986

[86] PCT No.: PCT/EP86/00667

§ 371 Date: Jul. 13, 1987

§ 102(e) Date: Jul. 13, 1987

[87] PCT Pub. No.: WO87/03019

PCT Pub. Date: May 21, 1987

[30] Foreign Application Priority Data

Nov. 18, 1985 [SE] Sweden ..... 8505455

[51] Int. Cl.[4] ..... B65H 51/20

[52] U.S. Cl. ..... 242/47.01; 242/147 R; 242/150 R

[58] Field of Search ..... 242/47.01, 47.02, 47.03, 242/47.04, 47.05, 47.06, 47.07, 47.08, 47.09, 47.1, 47.11, 47.12, 47.13, 150 R, 147 R, 153, 154; 66/132 R, 132 T; 139/452

[56] References Cited

U.S. PATENT DOCUMENTS

| | | | |
|---|---|---|---|
| 2,331,261 | 10/1943 | Wholton | 242/154 |
| 3,937,417 | 12/1973 | Guenther | 242/147 R |
| 3,999,717 | 9/1975 | Jacobsson | 242/47.01 |
| 4,114,823 | 9/1978 | Fecker et al. | 242/47.01 |
| 4,271,687 | 8/1978 | Memminger et al. | 242/47.01 X |

FOREIGN PATENT DOCUMENTS

| | | | |
|---|---|---|---|
| 602142 | 12/1925 | France | 242/154 |
| 2026554 | 2/1980 | United Kingdom . | |
| 2027456 | 2/1980 | United Kingdom . | |

*Primary Examiner*—Stanley N. Gilreath

*Attorney, Agent, or Firm*—Flynn, Thiel, Boutell & Tanis

[57] ABSTRACT

A yarn feeding device comprises a rotatable drum, a yarn-braking unit through which the yarn is guided at a certain wrapping angle, and a moveable detector element lying against the yarn for surveying the tension thereof and for detecting a possible yarn breakage. For enhancing the dynamic behavior of the detecting element and for reducing erroneous fault indication as generated by the detector element, the detector element is tensioned against the yarn such that the wrapping angle of the yarn passing the yarn-braking unit is increased when the yarn tension decreases.

6 Claims, 3 Drawing Sheets

YARN FEEDING DEVICE

FIELD OF THE INVENTION

The present invention relates to a yarn feeding device for feeding a yarn from a supply spool to a textile machine, said feeding device having a rotatable drum, a yarn-braking unit arranged between said supply spool and said rotatable drum, through which yarn-braking unit the yarn is guided at a certain wrapping angle, and a movable detector element arranged between said yarn-braking unit and said rotatable drum, said detector element lying against said yarn for surveying the tension of the yarn and for detecting a possible yarn-breakage.

BACKGROUND OF THE INVENTION

Yarn feeding devices of the above-indicated kind are used for positively feeding a yarn, for example, to a knitting station of a circular knitting machine. The rotatable drum is driven in synchronism with the operation of the circular knitting machine. Thus, the yarn supply to the knitting station also takes place in synchronism with the operation of the knitting machine. The yarn detector element usually has the form of a pivotable detector arm lying against a portion of the yarn between the yarn-braking unit and the rotatable drum. As long as no yarn breakage occurs and the yarn has its normal tension, the detector element has a first position. In case a yarn-breakage occurs or the tension of yarn falls essentially below the normal tension level, the detector element pivots around its axis and thereby operates a switch which is usually connected to a stop-motion-relay for terminating the operation of the knitting machine.

A prior art yarn feeding device of the above-mentioned kind is, for example, previously known from the references GB-A No. 2 026 554 and GB-A No. 2 027 456. At the prior art yarn feeding device as known from the first-mentioned reference, the detector element has the form of a pivotable sensing arm arranged between the yarn-braking unit in the form of a disc-brake and said rotatable drum. A yarn-guiding hook fixedly secured to the yarn feeding device is arranged between the detector arm or sensing arm and the rotatable drum so as to define a surveyed portion of the yarn between the disc-brake and the guiding hook. The sensing arm lies against the yarn due to its own weight. In case of a yarn-breakage, the sensing arm or detector arm of the prior art feeding device pivots downwardly and thereby actuates the stop-motion-relay which, in turn, immediately interrupts the operation of the circular knitting machine. Although yarn feeding devices of this type have proven to be reliable when processing normal yarns, problems occurred when feeding so-called "lively" yarns to the knitting machine. "Lively" yarns are, for example, twisted yarns which show a peculiar lively behaviour when feeding them. It has turned out that undesirable vibrations of the detector arm may occur during the feeding of these "lively" yarns resulting in an erroneous operation of the stop-motion-relay actuated by the detector arm although the average tension of the yarn has not fallen for a longer period of time below a critical value and although no yarn-breakage has occurred. In other words, the detector arm of the prior art yarn feeding device erroneously actuates a switch associated thereto, causing a fault indication, although no fault which is detrimental to the operation of the knitting machine, has occurred.

U.S. Pat. No. 3,937,417 discloses a yarn tensioning apparatus for generating a generally uniform output tension level of the yarn leaving the apparatus. It comprises an input roller, an output roller, a friction pin and a friction nose lying against the friction pin, which friction nose is pivotably arranged in the yarn tensioning apparatus. The pivotable friction nose is adapted for compensating for varying yarn tensions by increasing or decreasing the wrapping angle of the yarn with regard to the friction pin.

In view of the above prior art, the present invention is based on the object to accomplish a yarn feeding device of the above-indicated kind having an improved reliability in detecting feeding faults like insufficient yarn tension or yarn-breakage whilst preventing erroneous fault detections.

In accordance with the present invention, the detector element fulfills two tasks at the same time, namely the surveying of the tension of the yarn or the detection of possible yarn-breakage and a dynamic controlling of the brake force which is exerted by the yarn-braking unit on the yarn guided through it. The detector element compensates for a reduction in the yarn tension by increasing the wrapping angle of the yarn passing the yarn-braking unit. It has turned out that this unique double-function of the detector element of the claimed yarn feeding device guarantees an optimal dynamic behaviour of the detector element and of the yarn even when processing a so-called "lively" yarn. In addition, this yarn feeding device accomplishes an essentially constant yarn tension in the yarn fed to the rotatable drum, which prevents the yarn from losing contact with the braking unit, which problem occurred at the prior art yarn feeding device.

BRIEF DESCRIPTION OF THE DRAWINGS

Hereinafter, a preferred embodiment of the yarn feeding device in accordance with the present invention will be described in more detail with reference to the enclosed drawings, in which.

DETAILED DESCRIPTION

Figure 1:
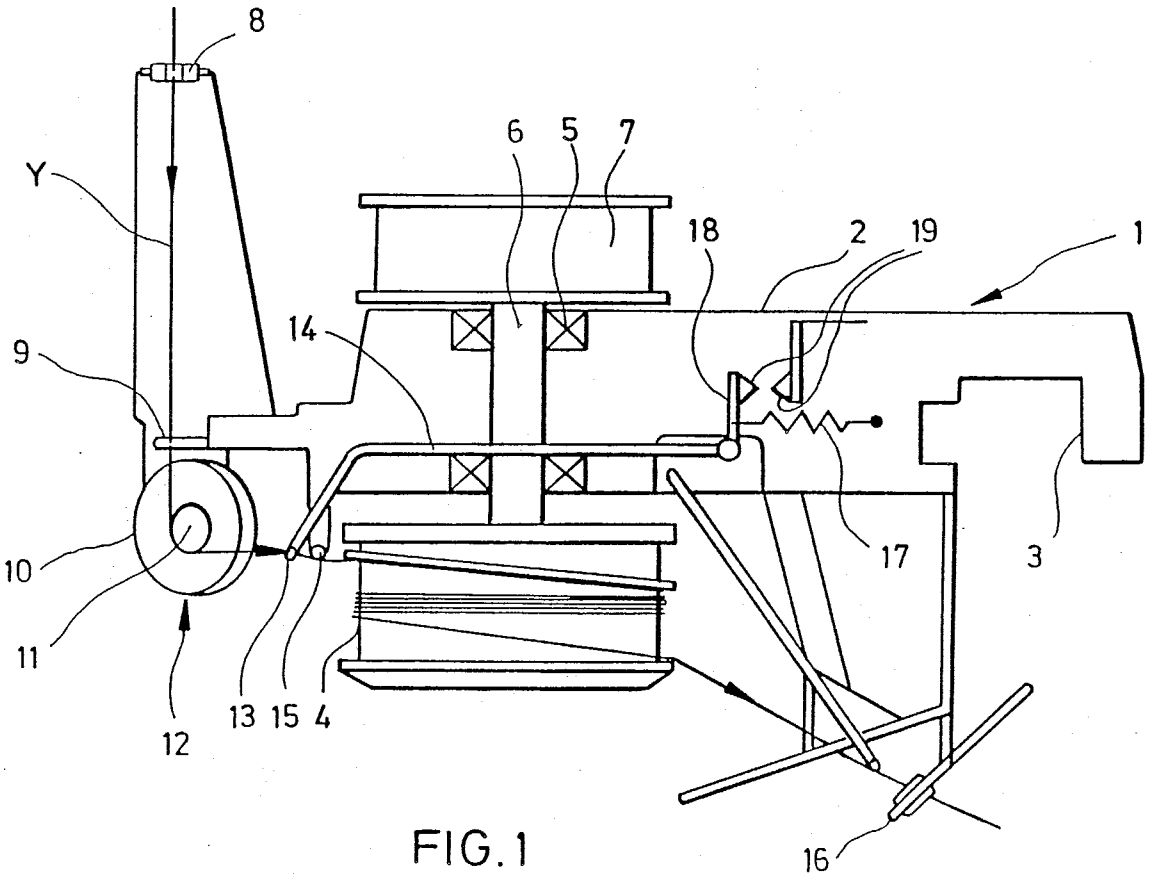
FIG. 1 shows a side view of a yarn feeding device.

A yarn feeding device 1 has a housing 2 defining a mounting recess 3 adapted for receiving a support ring of a circular knitting machine (not shown here) to which support ring the housing 2 of the yarn feeding device can be attached. A rotatable drum 4 is journalled with regard to the housing by means of roller bearings 5 for pivotably journalling a rotatable shaft 6 which is secured to the rotatable drum 4. The shaft 6 supports a drive wheel 7 which is driven in synchronism with the operation of the circular knitting machine (not shown here) by means of a drive belt (not shown) which engages the driving wheel 7. The yarn Y withdrawn from a supply spool (not shown here) passes through an input guiding eyelet 8 fixedly secured to the housing 2 and a guiding hook 9 which is also fixedly mounted to the housing 2. Thereinafter, the yarn Y passes between the two discs 10 and a non-rotatable brake shaft 11 of a disc brake 12 and runs over a detector arm 13 of a detector element 14 for detecting a yarn-breakage and for detecting a reduction in the tension of the yarn. Thereinafter, the yarn passes a horizontal guiding pin 15 attached to the housing 2 which also generates a certain friction which favourably damps the movement of the yarn Y before it reaches the rotatable drum 4.

A few turns of the yarn Y are wound around the rotatable drum 4. The yarn leaving the drum runs through an output guiding eyelet 16 before it reaches a knitting station (not shown) of the circular knitting machine.

The detector element 14 is pivotally journalled at its knee at the right-hand end thereof. An upright portion 18 is engaged by a spring 17 exerting a force on said upright portion 18 which tends to pivot the detector element 14 is a clockwise direction. Hence, the arm 13 of the detector element 14 abuts against the yarn Y in an upward direction and, thus, tends to upwardly displace the yarn in the region between the braking unit 12 and the horizontal guiding pin 15 such that the wrapping angle of the yarn passing the discs 10 and the shaft 11 of the braking unit 12 is increased.

In case a yarn-breakage occurs, the detector element 14 pivots in the clockwise direction. Hence, the upright portion 18 of the detector element 14 closes a switch 19 formed by contacts located on the upright portion 18 and the housing 2 which, in turn, actuates a stop-motion-relay (not shown) for terminating the operation of the circular knitting machine.

Figure 2:
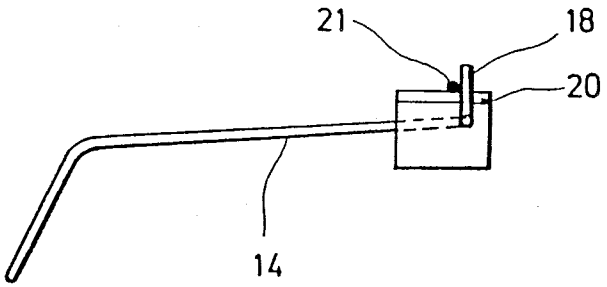
FIG. 2 shows a side view on a detector element of the yarn feeding device in accordance with FIG. 1.
Figure 3:
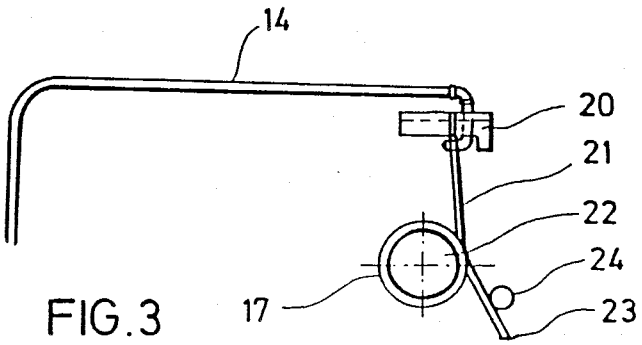
FIG. 3 shows a top view of the detector element as shown in FIG. 2.

As shown in detail at FIGS. 2 and 3, the yarn detector element 14 is journalled at a support bearing 20 secured to the housing 2. The upright portion 18 is pre-tensioned by a leg 21 of the spring 17 which is held by a support pin 22 and which rests with its second leg 23 against an abutment pin 24.

Figure 4:
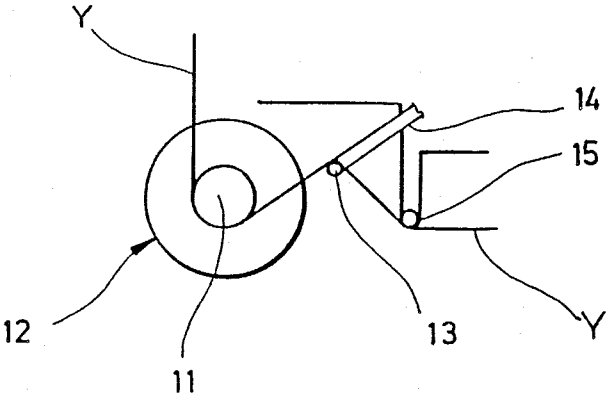
FIG. 4 is a detail of the yarn feeding device as shown in FIG. 1 in case of a reduced yarn tension.

FIG. 4 shows a detail of the side view of the yarn feeding device in accordance with FIG. 1 at a reduced yarn tension. If the tension of the yarn coming from the spool decreases, the detector element 14 pivots in the clockwise direction and thereby moves its detector arm 13 in an upward direction. Hence, the wrapping angle of the yarn around the shaft 11 of the disc brake 12 increases, so that the yarn braking force exerted by the disc brake on the yarn Y is increased accordingly. Hence, changes in the yarn tension coming from the supply spool are essentially compensated for when leaving the disc brake 12. This tension compensation minimises vibrations of the detector element 13 when processing so-called "lively" yarn. Therefore, the tendency of erroneously generating a fault indication by actuating the stop-motion-relay in case of short-time occurrences which are not detrimental to the operation of the knitting machine is essentially reduced when compared to the tendency of generating erroneous fault-indications in the prior art yarn feeding device.

Figure 5:
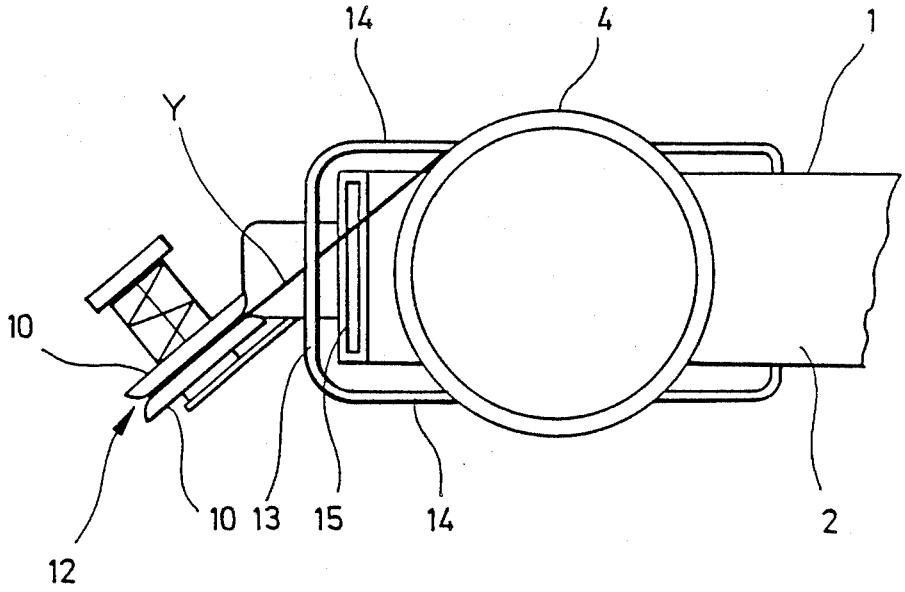
FIG. 5 shows a top view of the feeding device in accordance with FIG. 1.

FIG. 5 shows a top view on the yarn feeding device in accordance with FIG. 1. For obtaining a desirable tangential feeding of the yarn to the drum 4, the disc brake 12 is arranged in an inclined position with regard to the horizontal axis of the feeding device 1.

The detector element 14 of the preferred embodiment has the form of a bow or bracket which is pivotably journalled at one end and which includes the detector arm 13 at the opposite end thereof. However, the detector element may also have the form of any suitable element which is adapted for lying against the yarn under a load for tensioning the yarn such that the wrapping angle of the yarn passing the braking unit is increased by the detector element when the yarn tension decreases.

Preferably, the yarn-braking unit has the form of a disc brake having a fixed shaft 11 and two discs 10. Alternatively, any braking unit having a braking force depending on the wrapping angle of the yarn can be used instead of a disc brake.

I claim:

1. In a yarn feeding device for feeding a yarn from a supply spool to a textile machine, said device having a rotatable drum on which the yarn is wound, a yarn braking unit arranged between the supply spool and the rotatable drum and over which the yarn is guided at a certain wrapping angle as the yarn is fed to the drum, and movable detector means for monitoring the tension of the yarn and for detecting possible yarn breakage, said detector means including a movable detector element which lies against the yarn as it is fed from the braking unit to the drum, comprising the improvement wherein the detector element is biased against the yarn in a direction which effects displacement of the yarn in response to a reduction in yarn tension so as to increase the wrapping angle of the yarn as it passes over the yarn braking unit.

2. A yarn feeding device according to claim 1, wherein the braking unit comprises a disk brake.

3. A yarn feeding device according to claim 1, wherein a stationary yarn guiding eyelet is arranged for contacting the yarn between the supply spool and the braking unit, and wherein a stationary guiding element guidingly contacts the yarn at a location between the detector element and the rotatable drum.

4. A yarn feeding device according to claim 1, wherein the detector element is spring biased into engagement with the yarn.

5. A yarn feeding device according to claim 1, wherein the detector means comprises an elongate leverlike element which is pivotally journalled with respect to a stationary housing at one end thereof and which at the opposite end thereof has said detector element for contact with the yarn.

6. A yarn feeding device for controlling feeding of a yarn from a supply spool to a textile machine, said device comprising:

a substantially cylindrical drum supported for rotation about its longitudinal axis, the drum adapted to have a yarn wound therearound after withdrawal from the supply spool but prior to feeding of the yarn to the textile machine;

a yarn braking unit arranged adjacent and spaced radially outwardly from one side of said drum for engaging the yarn as it is fed from the supply spool to the drum, said yarn braking unit causing the yarn to be deflected so as to engage the braking unit through a certain wrapping angle, the braking unit being oriented relative to the drum so that the yarn leaving the braking unit extends for substantially tangential contact with drum;

a stationary eyelet disposed for guidingly contacting the yarn as it extends from the supply spool to the braking unit for guiding the yarn into engagement with the braking unit;

a stationary yarn-guiding element disposed radially outwardly from the drum and interposed generally between the drum and the braking unit for guidingly engaging the yarn which extends from the braking unit tangentially onto the drum; and detector means having a yarn-engaging part urged into engagement with the section of yarn which extends between said braking unit and said guiding element for monitoring the tension of the yarn and for sensing breakage thereof, said detector means including spring means biasing said detector part into engagement with said yarn section in such direction as to cause sideward deflection of said yarn section to create a looplike deviation therein so that the yarn section at one end is maintained in engagement with the guiding element whereas the yarn section at its other end causes an increase in the wrapping angle of the yarn as it passes around the braking unit to minimize erroneous fault detections.

* * * * *